United States Patent [19]

Morewood

[11] Patent Number: 5,037,261

[45] Date of Patent: Aug. 6, 1991

[54] SPOON SUPPORT MECHANISM IN A SELF-FEEDING DEVICE FOR HANDICAPPED PERSONS

[75] Inventor: William H. Morewood, Pennington, N.J.

[73] Assignee: Winsford Products, Inc., Pennington, N.J.

[21] Appl. No.: 447,644

[22] Filed: Dec. 8, 1989

[51] Int. Cl.[5] ..... A47G 21/08

[52] U.S. Cl. ..... 414/9; 414/4; 414/706; 414/777

[58] Field of Search ..... 414/9, 4, 7, 706, 709, 414/733, 777; 198/468.6

[56] References Cited

U.S. PATENT DOCUMENTS

| | | | |
|---|---|---|---|
| 1,933,275 | 10/1933 | Melucci | 414/9 |
| 2,608,073 | 8/1952 | Hill | 414/9 |
| 2,686,408 | 8/1954 | Walker | 414/9 |
| 3,734,306 | 5/1973 | Morewood | 414/9 |
| 3,885,681 | 5/1975 | Mancino | 414/9 |
| 4,277,213 | 7/1981 | Morewood | 414/9 |
| 4,433,950 | 2/1984 | Hanger et al. | 414/9 |
| 4,522,543 | 6/1985 | Robinson | 414/9 |

*Primary Examiner*—Frank E. Werner
*Assistant Examiner*—Brian K. Dinicola
*Attorney, Agent, or Firm*—Ostrolenk, Faber, Gerb & Soffen

[57] ABSTRACT

A self-feeding device for automatically lifting food off of an eating surface of a plate to an eating position located above the device includes a plate and a plate support. A spoon support mechanism moves a spoon from an upper eating position to a lower food receiving position and causes the spoon to travel along a predetermined path on the eating surface of the plate to load food located along the path on to the spoon as the spoon moves from the upper eating position to the lower food receiving position.

55 Claims, 7 Drawing Sheets

SPOON SUPPORT MECHANISM IN A SELF-FEEDING DEVICE FOR HANDICAPPED PERSONS

BACKGROUND OF THE INVENTION

The present invention relates to self-feeding devices for handicapped persons, and particularly to self-feeding devices that are capable of effectively picking up food off of the eating surface of a plate.

A self-feeding device of the foregoing type is described in U.S. Pat. No. 4,277,213 issued to the inventor of the present invention which is incorporated by reference. While the foregoing device represents a major improvement over the self-feeding devices of the prior art, it has some drawbacks.

In the self-feeder of the foregoing patent, a spoon holding and lifting mechanism automatically moves a spoon between a lower food receiving position located adjacent an eating surface of a plate containing a meal to be eaten and an upper eating position located adjacent the mouth of an operator of the self-feeding device. The operator controls the feeder by means of a chin switch. As the spoon is moved from the upper to the lower food receiving position, it is held at a nearly constant angle relative to the plate. At the lower food receiving position, the spoon rests on top of the eating surface of the plate and food is loaded on to the spoon by a pusher traversing the eating surface of the plate. Movement of the pusher is also controlled by the operator through use of the chin switch. The chin switch is also able to control rotation of the plate to regulate the type of food pushed on to the spoon.

The primary drawback of this self-feeder is that when the spoon is moved from the upper eating position to the lower food receiving position, it would sometimes come to rest on top of the food (and not the surface of the plate) thus preventing the pusher from effectively loading the spoon. This has limited the usefulness of the self-feeder for those with poor head control because they were unable to stop the plate at a time when a clear spot was beneath the spoon.

Accordingly, it is an object of the present invention to provide a self-feeding device that will effectively load food onto the spoon even if food covers the area of the plate to which the spoon is descending.

Another object is to provide an apparatus which will reliably fill the spoon when used by persons with poor control of their head motion.

A further object is to provide an apparatus such that little concentration will be required from users who have good control of their head motion.

Still another object is to provide an apparatus which is of simple and economical construction, and inexpensive to manufacture and use.

SUMMARY OF THE INVENTION

It has now been found that the above and other objects of the present invention are attained in a self-feeding device for lifting food off of an eating surface of a plate to an eating position located above the device comprising means for supporting a plate having an eating surface, a spoon and a spoon support means. The spoon support means moves the spoon from an upper eating position to a lower food receiving position. The spoon support means also causes the tip of the spoon to strike near the rim of the plate and to travel along a predetermined path on the eating surface of the plate to load food located along the path onto the spoon as the spoon moves from the upper eating position to the lower food receiving position.

In a preferred embodiment the self-feeding device further comprises human actuable control means operable in a first mode and a second mode. In the first mode the control means causes the spoon support means to move the spoon from the upper eating position to the lower food receiving position. In the second mode the spoon support means moves the spoon from the lower food receiving position to the upper eating position after the food has been loaded on to the spoon. The spoon support means includes a spoon-tilting mechanism to cause the tip of the spoon to move along an arcuate path as it moves from the lower food receiving position and, means to maintain the spoon at a nearly constant angle relative to the plate when the spoon moves from the lower food receiving position.

Preferably the spoon-tilting mechanism includes a spoon-lifting arm rotatable about a first predetermined axis and means to rotatably couple the spoon to the arm about a second predetermined axis. The means to rotatably couple the spoon includes means to rotate the spoon about the second axis. Preferably the means to rotatable couple the spoon includes means to rotate the spoon about the second axis when the arm rotates about the first axis, and the first axis is parallel to the second axis. Preferably the spoon is resiliently coupled to the spoon-lifting arm and the spoon rotates about the second axis from the upper eating position in a generally arcuate path so that the tip of the spoon traverses the eating surface of the plate at the lower food receiving position.

The means to rotate the spoon includes a latch ring rotatable about the first axis and a notch formed in the latch ring. Preferably the means to rotate the spoon further includes a latch and a return cam assembly pivotable about a third predetermined axis and coupled to the latch ring to regulate rotation of the latch ring. The latch and return cam assembly includes a latch plate assembly having a latch plate pivotable about the third axis and a latch plate pin projecting from the latch plate. Preferably the third axis is parallel to the first axis. The latch plate blocks rotation of the latch ring in a latch position by abutting the notch when the arm is moved from the lower food receiving position to maintain the spoon at a nearly constant angle relative to the plate. The latch plate permits rotation of the latch ring in an unlatched position by disengaging the latch ring when the arm is moved from the upper eating position.

The latch and return cam assembly further includes a return cam having means to engage the latch plate pin, a link to couple the return cam to the latch ring, and a cam support pivotable about the third axis fixed to the return cam and positioned between the latch plate and the return cam. The cam support includes means to allow the latch plate pin to pass therethrough. The return cam causes the latch ring to rotate when the latch plate is in the unlatched position. The means to rotate the spoon further includes a cam and guide block assembly rotatable about the first axis to unlatch the latch ring.

The cam and guide block assembly includes a cam block and a cam follower pin projecting from the cam block towards the return cam. When the arm is moved from the upper eating position the cam block engages the latch plate pin to unlatch the latch ring, to engage the return cam and to rotate the latch ring. The latch plate pin then becomes disengaged with the cam block, releasing the latch plate and causing the cam follower pin to push the return cam to rotate the latch ring back into the latched position. Preferably the latch ring is rotated counterclockwise to cause the spoon to tilt in the downwardly direction and the latch ring is rotated clockwise to cause the latch ring to rotate into the latched position

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

DETAILED DESCRIPTION OF THE PREFERRED EMBODIMENT

Figure 1:
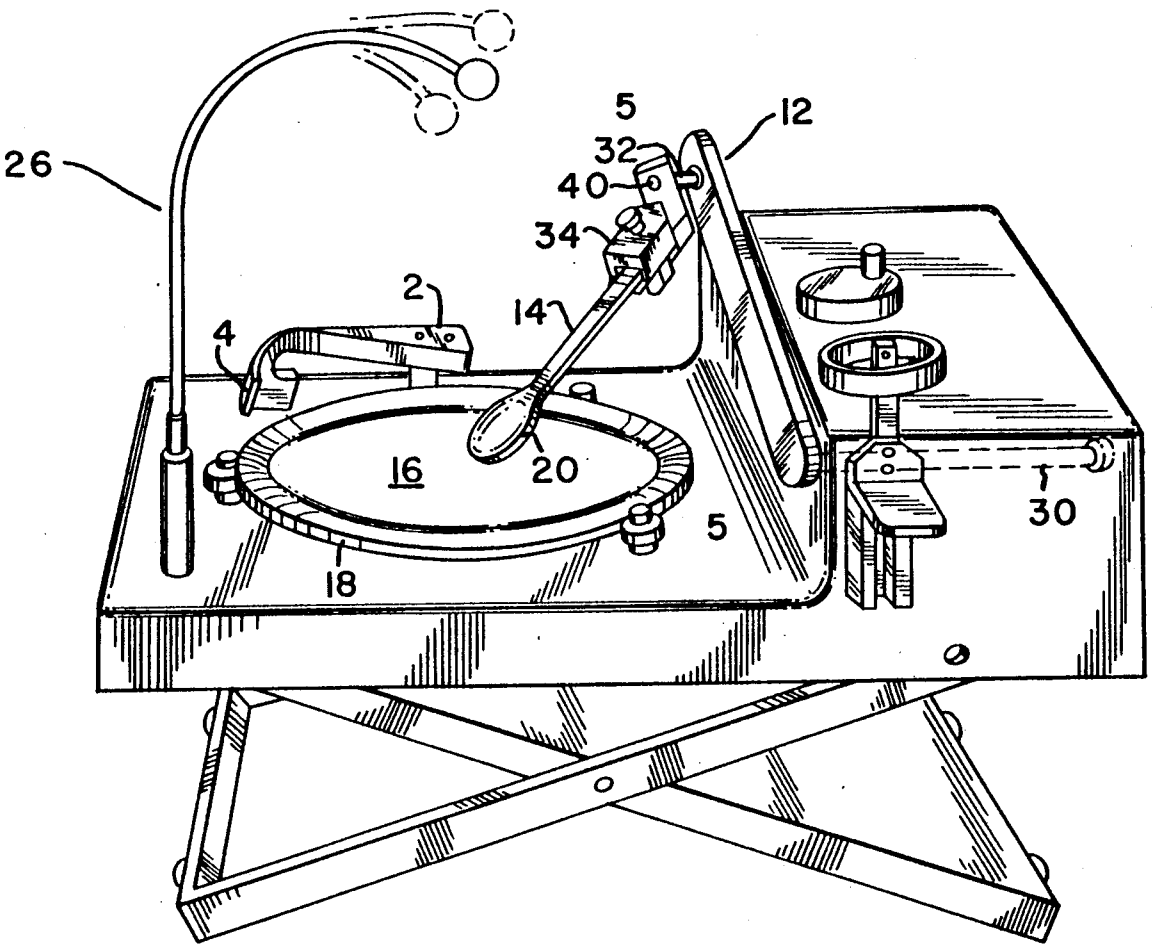
FIG. 1 is a perspective view of the self-feeding device of the present invention.

Referring now to the drawings wherein like numerals indicate like elements, there is shown a self-feeding device designated generally as 10. The self-feeding device 10 includes a housing 11 and spoon-tilting mechanism 12 which moves a spoon 14 from an upper eating position to a lower food receiving position in response to the actuation of a control switch 26 coupled to an appropriate control means (a suitable control means is described in U.S. Pat. No. 4,277,213). As the spoon 14 moves from the upper eating position to the lower food receiving position, FIG. 3, the spoon-tilting mechanism 12 also rotates the tip of spoon 14 in a generally arcuate path in the vertical direction from a generally horizontal orientation. (Stated otherwise, the angle between the longitudinal axis of the spoon 14 and the generally planar eating surface 16 of the plate 18 varies as the spoon is moved from the upper eating position to the lower food receiving position.) The spoon 14 rotates in an arcuate path until a tip 20 of the spoon 14 reaches the outer rim of the plate 18. Once the tip 20 reaches the outer rim of the plate 20, further movement of the spoon-tilting mechanism 12 causes the spoon 14 to travel along the eating surface 16 of the plate 18 in a predetermined path to scoop food located along the path on to the spoon 14. It will be appreciated by those skilled in the art that the path of the spoon 14 can be altered so that a portion of the spoon 14 other than the tip 20 can traverse and travel along the eating surface 16 of the plate 18.

Before the spoon traverses the eating surface 16 of the plate 18, the plate 18 can be rotated by suitable plate rotation means (a suitable plate rotation means as described in U.S. Pat. No. 4,277,213) to selectively position food along the path of movement of the spoon 14. The plate rotation means can also be controlled by the control switch 26.

Figure 2:
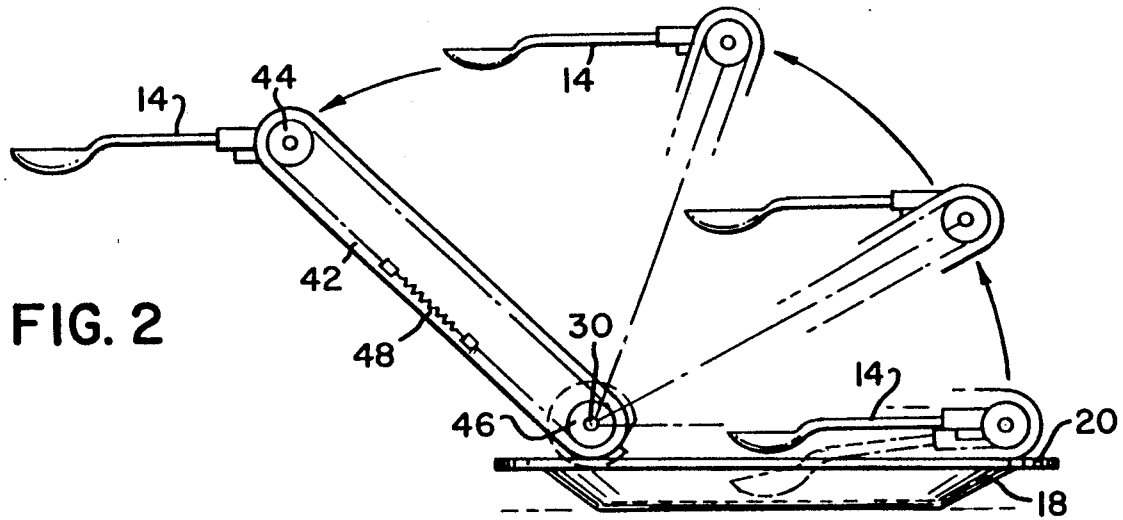
FIG. 2 is a side elevation view of the spoon-lifting arm of the present invention moving a spoon from the lower food receiving position to the upper eating position.

Once the spoon 14 has scooped food on to the spoon 14, the spoon 14 comes to rest on the plate 18 in substantially horizontal orientation as shown in FIG. 2. In this position a pusher arm 2 including a pusher surface 4, FIG. 1, also controlled by the control means actuated by control switch 26, can be utilized as a secondary means of loading food not located along the path of movement of the spoon 14 on to the spoon 14.

Referring now to FIG. 2, once food has been loaded on to the spoon 14, the spoon 14 travels to the upper eating position at a nearly constant angle relative to the plate 18. This prevents food from falling off of the spoon 14 and maintains the spoon 14 at the proper orientation to allow the food to be easily ingested by an operator of the self-feeding device 10.

Figure 3:
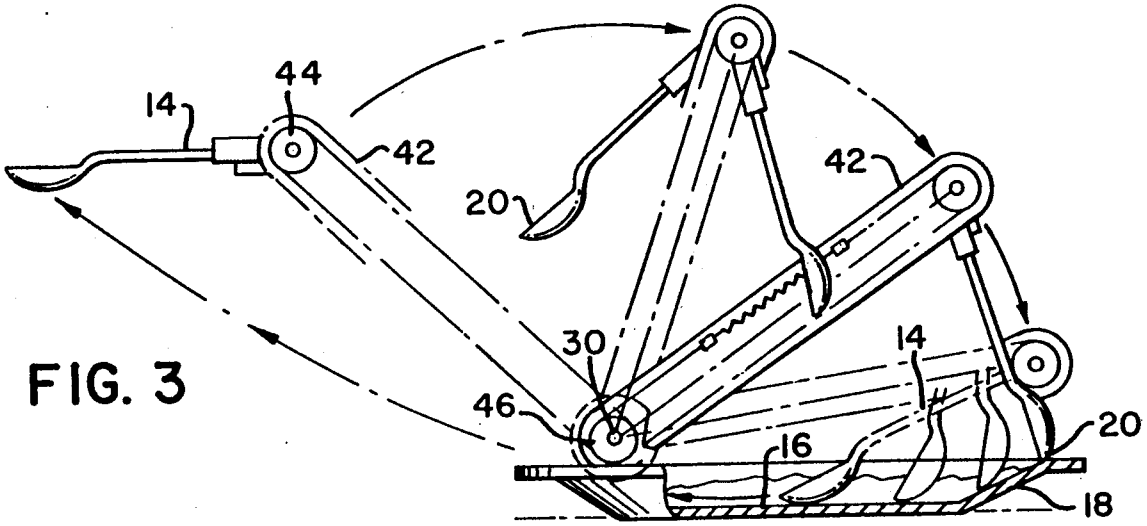
FIG. 3 is a side elevation view of the spoon-lifting arm moving the spoon from the upper eating position to the lower food receiving position.
Figure 4:
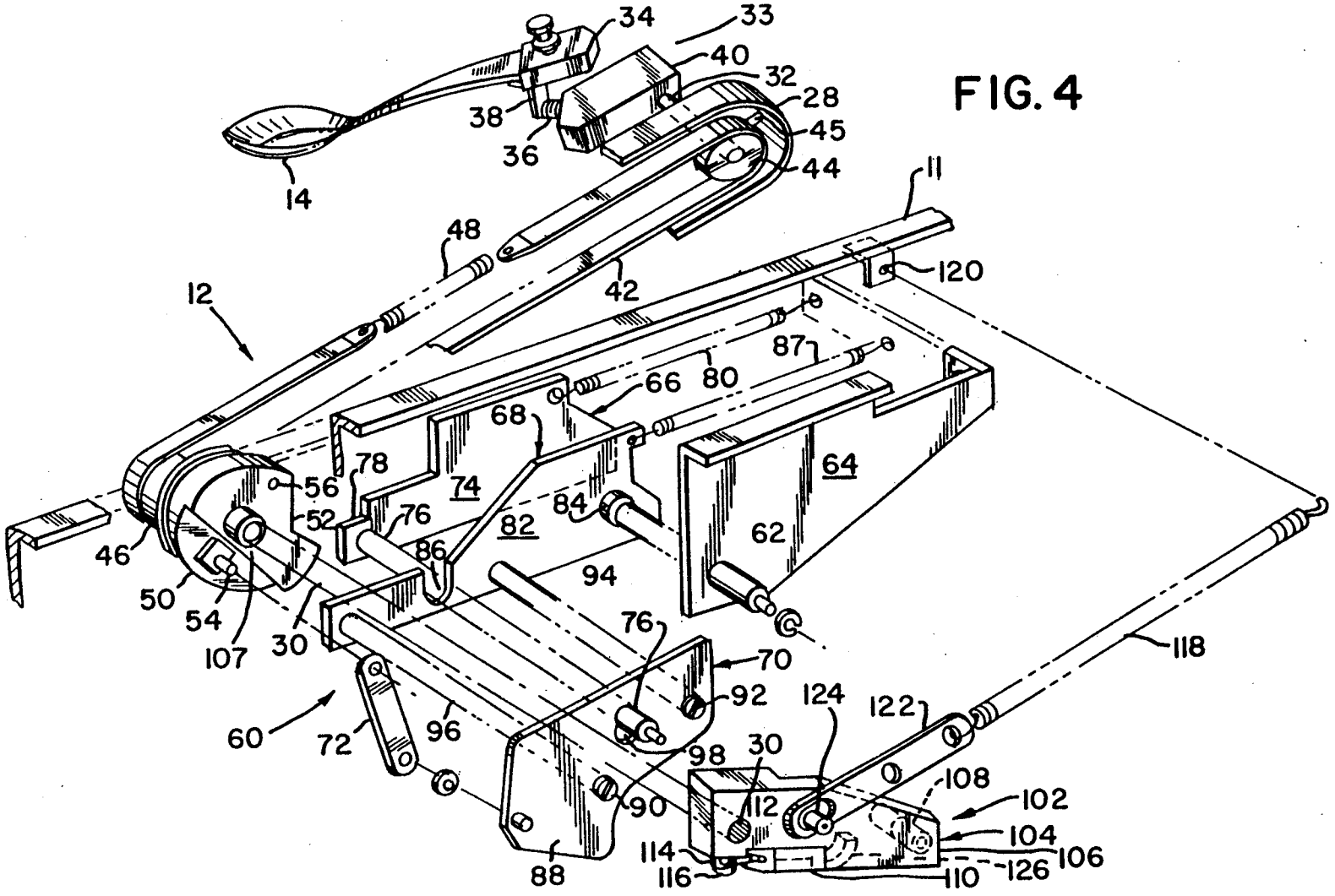
FIG. 4 is an exploded perspective view of the spoon-tilting mechanism of the present invention.
Figure 5:
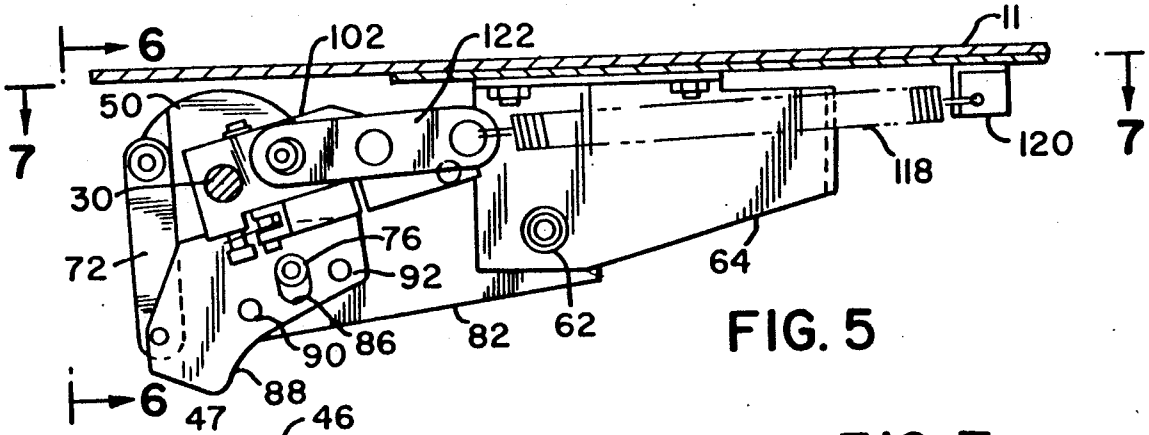
FIG. 5 is a cross-sectional view of the spoon-tilting mechanism taken along line 5—5 of FIG. 1 engaged in the upper eating position.

The details of the spoon-tilting mechanism 12 are best illustrated in FIG. 4 which is an exploded perspective view of the spoon-tilting mechanism 12. As shown therein, the spoon-tilting mechanism 12 includes a spoon-lifting arm 28, partially broken away, which is rotatable with a main shaft 30. The spoon-lifting arm 28 moves the spoon 14 from the upper eating position to the lower food receiving position in response to rotation of the main shaft 30. The spoon 14 is rotatably coupled to the spoon-lifting arm 28 by a spoon shaft 32 which allows the spoon 14 to rotate along a generally arcuate path when the spoon-lifting arm 28 moves the spoon from the upper eating position as seen in FIG. 3.

The spoon 14 is coupled to the spoon shaft 32 by clamping means 33. The clamping means 33 includes a spoon clamp 34 to hold the spoon 14, a tension spring 36 coupled to the spoon clamp 34 by a bracket 38 and, a joining member 40 coupled to the spoon shaft 32 and tension spring 36 on opposite ends of the joining member 40. The tension spring allows the spoon 14 to rotate independently of the spoon shaft 32 in the event that the spoon 14 is moved against a stationary object. While stiff enough to ensure that the spoon 14 normally rotates with the shaft 32, it is sufficiently bendable to prevent injury to the user of the self-feeding device 10 if the spoon 14 comes into contact with an immovable object.

Figure 7:
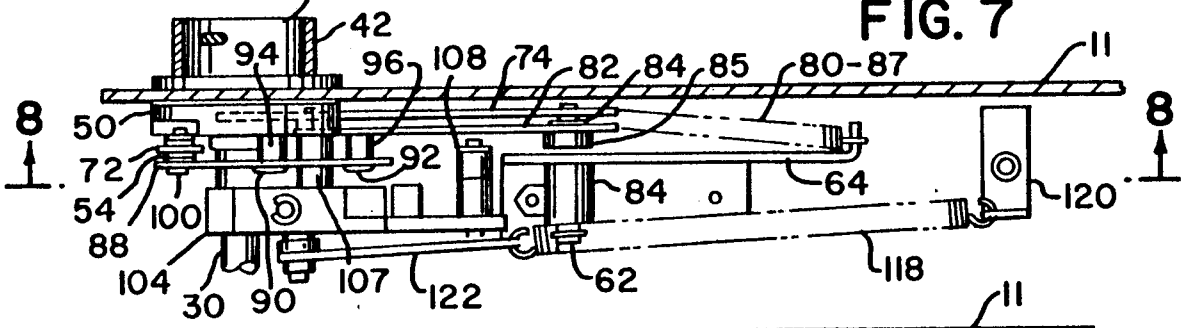
FIG. 7 is a partial cross-sectional view of the spoon-tilting mechanism of FIG. 6 taken along line 7—7 of FIG. 5.

The arcuate movement of the spoon 14 is controlled by a belt 42 extending between a pair of pulleys 44, 46 located within opposite ends of the spoon-lifting arm 28. The belt 42 runs over a spoon shaft pulley 44 rotatable with the spoon shaft 32 and a main shaft pulley 46 rotatable around the main shaft 30. Preferably the belt 42 is fixed to the spoon shaft pulley 44 by a pin 45 and to the main shaft pulley 46 by a pin 47 as best seen in FIG. 7. The opposite ends of the belt 42 are joined by a spring 48. Rotation of the main shaft pulley 46, and the spoon shaft pulley 44 by the belt 42, causes the spoon shaft 32 to rotate the spoon 14 along the generally arcuate path of FIG. 3.

Figure 6:
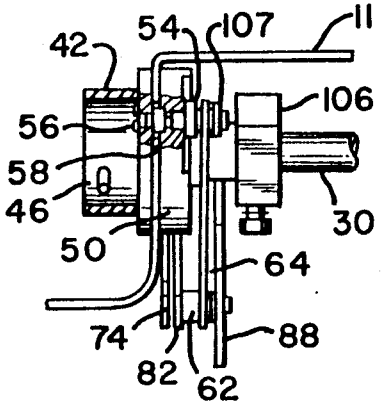
FIG. 6 is a partial cross-sectional view of the spoon-tilting mechanism taken along line 6—6 of FIG. 5.

The main shaft pulley 46 is coupled to a latch ring 50 having a notch 52 formed therein. The latch ring 50 is also rotatable around the main shaft 30. Rotation of the latch ring 50 causes the spoon shaft 32 to rotate the tip of spoon 14 along the generally arcuate path of FIG. 3 as described above. As best seen in FIGS. 4 and 6, the main shaft pulley 46 is coupled to the latch ring 50 by a latch ring pin 54, and two screws 56. The main shaft pulley 46 includes a shoulder bushing 58 spaced between the main shaft pulley 46 and the latch ring 50. Rotation of the latch ring 50 around the main shaft 30 causes the belt 42 to impart rotation on the spoon shaft pulley 44. Rotation of the spoon shaft pulley 44 causes the spoon 14 to rotate along a generally arcuate path.

Referring now to FIGS. 4–8, a latch and return cam assembly 60, part of the spoon-tilting mechanism 12, regulates the rotation of the latch ring 50. The latch and return cam assembly 60 is pivotable about a pivot shaft 62. The pivot shaft 62 projects from a pivot bracket 64 which is fixed to the housing 11 of the self-feeding device 10. The latch and return cam assembly 60 includes a latch plate assembly 66, a cam support assembly 68, a return cam assembly 70 and a link 72. The link 72 couples the return cam assembly 70 to the latch pin 54.

The latch plate assembly 66 includes latch plate 74 pivotable about the pivot shaft 62 and a latch plate pin 76 projecting outwardly from the latch plate 74. The latch plate 74 includes a step gradation 78 formed therein to enter into abutting relationship with the notch 52 of the latch ring 50. As will be explained more fully below, the step gradation 78 of the latch plate 74 normally enters into abutting relationship with the notch 52 of the latch ring 50 to block rotation of the latch ring 50. When rotation of the latch ring 50 is blocked, the spoon 14 is prevented from rotating about the spoon shaft 32 and, therefore, the spoon 14 is prevented from moving along an arcuate path. For this reason the rotation of the latch ring 50 is blocked when the spoon 14 moves from the lower food receiving position to the upper eating position. The latch plate 74 is attached to a spring 80 fixed to the pivot bracket 64 to bias movement of the latch plate 74.

The cam support assembly 68 is pivotable about the pivot shaft 62 and includes a cam support 82 positioned proximate and substantially parallel to the latch plate 74. Spaced between the latch plate 74 and the cam support 82 on the pivot shaft 62 is a spacer 84, best seen in FIG. 7. Similarly, spaced between the cam support 82 and the pivot bracket 64 is a spacer 85 located on the pivot shaft 62. The cam support 82 also includes a notch 86 formed therein, best seen in FIG. 4, to permit the latch plate pin 76 to pass through the cam support 82. The cam support 82 is attached to a spring 87 fixed to the pivot bracket 64 to bias movement of the latch plate 74.

The return cam assembly 70 includes a return cam 88 fixed to the cam support 82 by screws 90 and 92. A pair of spacers 94 and 96 (FIG. 7) are positioned between the return cam 88 and the cam support 82 on the screws 90 and 92, respectively. The return cam 88 also includes an opening 98 formed therein, best seen in FIG. 4, to permit the latch plate pin 76 to pass through and engage the return cam 88. The return cam assembly 70 is coupled to the latch ring 50 by the link 72. One end of the link 72 is coupled to the return cam 88 by a cam lock pin 100. The opposite end of the link 72 is coupled to the latch ring 50 by the latch ring pin 54.

A cam and guide block assembly 102 is rotatable with the main shaft 30 to regulate movement of the latch and return cam assembly 60. The cam and guide block assembly 102 includes a cam block assembly 104 having a cam block 106 rotatable with the main shaft 30. A spacer 107 on the main shaft 30, best seen in FIG. 6, is positioned between the cam block 106 and the latch ring 50. The cam block 106 has a cam follower pin 108 projecting outwardly from the cam block 106 towards the return cam 88. The cam and guide block assembly 102 also includes a guide block 110 pivotable about a guide block pin 112 projecting outwardly from the cam block 106. The guide block 110 pivots along a plane parallel to the bottom surface of the cam block 106. Movement of the guide block 110 is biased by a guide block torsion spring 114 fixed to a post 116 and the guide block pin 112. Movement of the cam and guide block assembly 102 is biased by a spring 118 attached to the housing 11 of the self-feeding device 10 by a bracket 120. The spring 118 is coupled to the cam and guide block assembly 102 by a link 122 secured to a post 124 projecting from the cam block 106.

Figure 8:
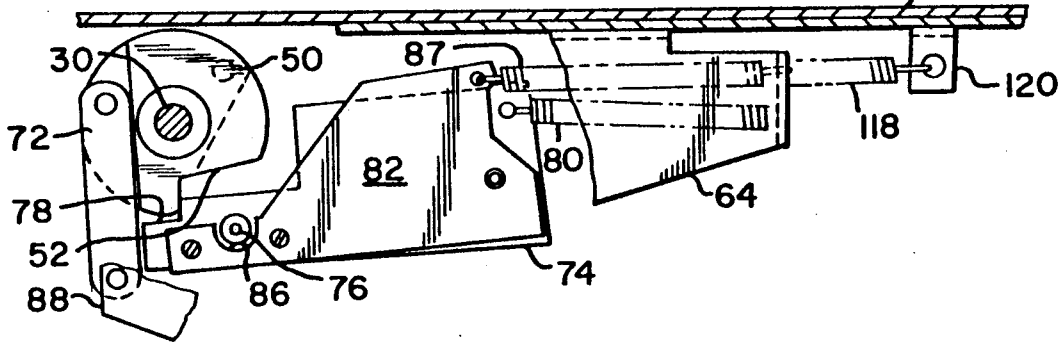
FIG. 8 is a cross-sectional view of the spoon-tilting mechanism of FIG. 7 taken along line 8—8 of FIG. 7.
Figure 10:
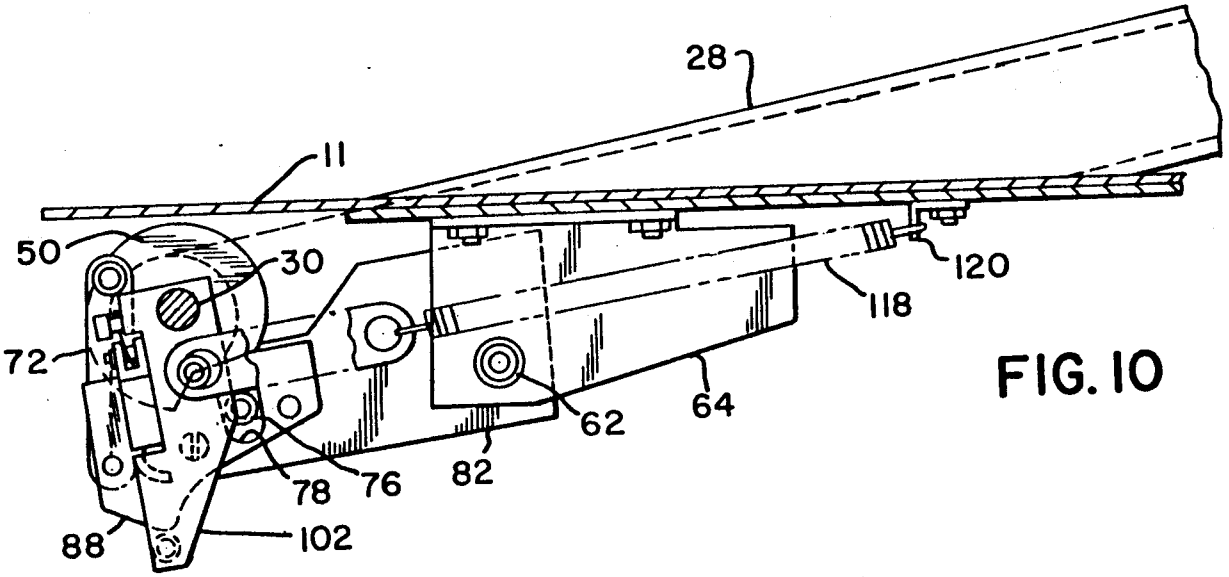
FIG. 10 is the cross-sectional view of the spoon-tilting mechanism of FIG. 9 engaged in the lower food receiving position.
Figure 9:
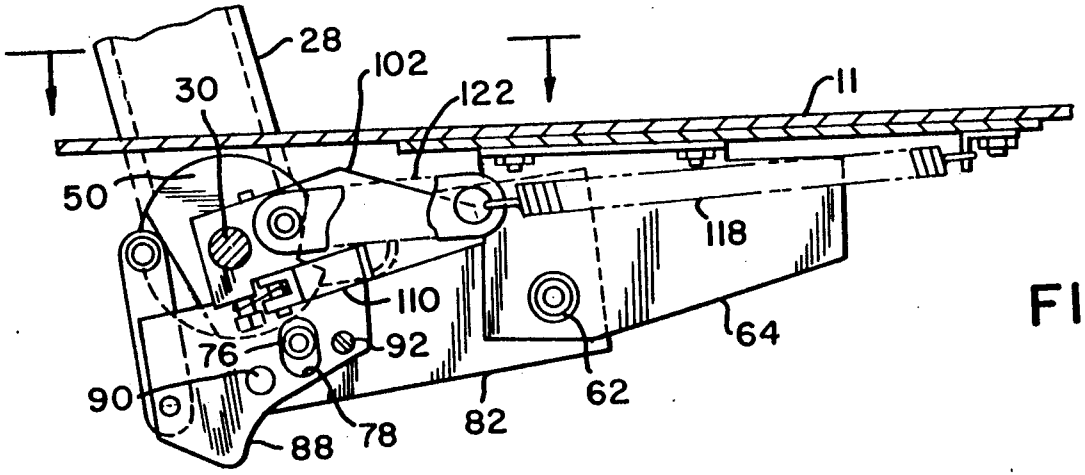
FIG. 9 is the cross-sectional view of the spoon-tilting mechanism of FIG. 5 partially broken away.
Figure 11:
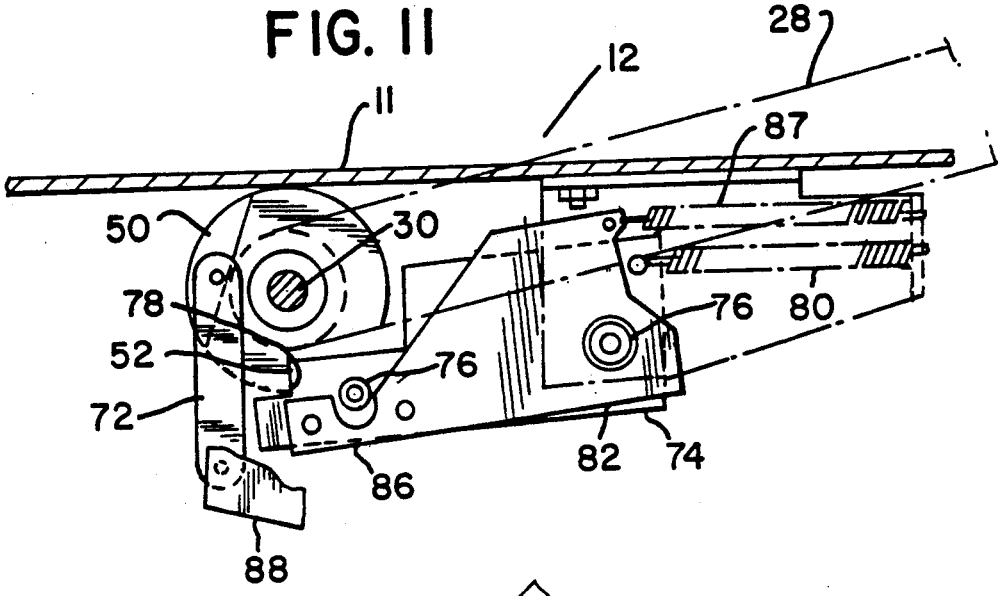
FIG. 11 is the cross-sectional view of the spoon-tilting mechanism of FIG. 8 engaged in the lower food receiving position.
Figure 12:
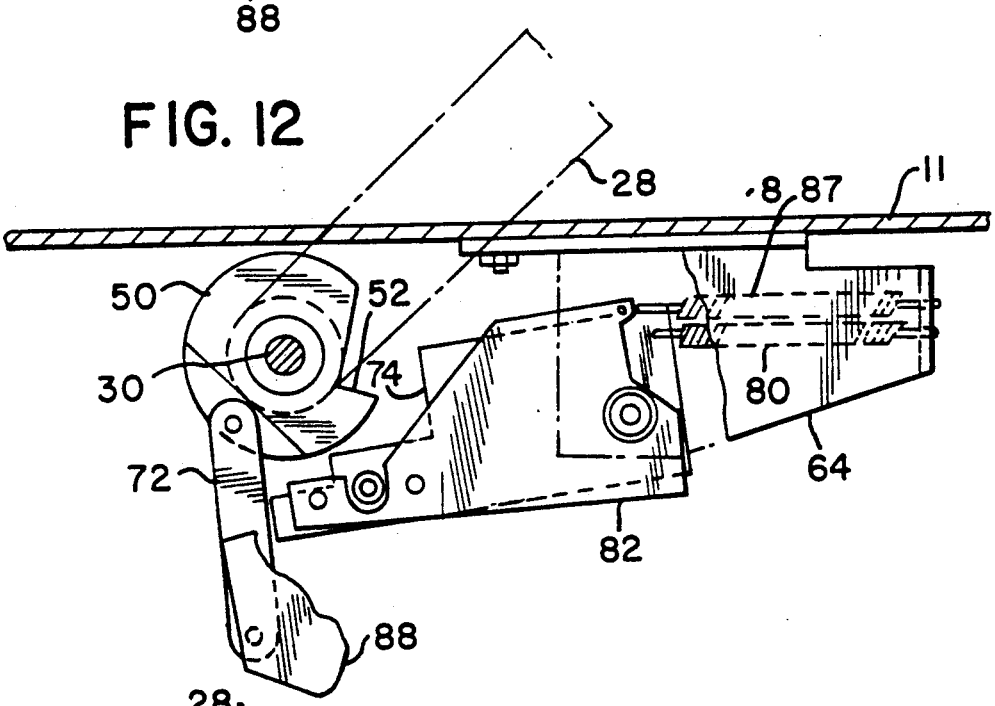
FIG. 12 is the cross-sectional view of the spoon-tilting mechanism of FIG. 11 engaged midway between the upper and lower food positions.

Referring now to FIGS. 5–9, in the upper eating position the step gradation 78 of the latch plate 74 abuts the notched portion 52 of the latch ring 50 to block counterclockwise rotation of the latch ring 50 as best seen in FIG. 8. This is referred to as the latched position. The spoon-tilting mechanism 10 is also engaged in the latched position when moving from the lower food receiving position, FIG. 10 and FIG. 11, to the upper eating position. See FIG. 2.

When the spoon-tilting mechanism 12 is engaged in the latched position, counterclockwise rotation of the main shaft pulley 46 is blocked so that the spoon 14 will be held at a constant angle relative to the plate 18. Thus, when the spoon-tilting arm 28 is moved from the lower food receiving position to the upper latching position by rotation of the main shaft 30, the belt 42, secured to stationery main shaft pulley 46 by pin 47, causes the spoon shaft pulley 44 and the spoon shaft 32 to rotate in the clockwise direction relative to the movement of arm 28. Spoon shaft pulley 44 and spoon shaft 32 stay stationary relative to housing 11 and arm 28 rotates relative to housing 11. As a result, the spoon 14 is maintained at a nearly constant predetermined angle relative to the plate 18. Similarly, when the spoon-tilting arm 28 is initially moved from the upper eating position toward the lower food receiving position by rotation of the main shaft 30, the spoon 14 is maintained at a nearly constant angle relative to housing 10. When the spoon lifting arm 28 has moved a predetermined distance toward the lower food receiving position, the step gradation portion 78 of the latch plate 74 disengages the notched portion 52 of the latch ring 50 (by a means that will be fully explained below) and the latch plate assembly 66 (and with it the spoon-tilting mechanism 12) will be moved into the unlatched position. In the unlatched position, the latch ring 50 and the main shaft pulley 46 are allowed to rotate in the counterclockwise direction to cause the belt 42 to also rotate the spoon shaft pulley 44 and the spoon shaft 32 in the counterclockwise direction. As a result, the angle formed between the longitudinal axis of spoon 14 the generally planar eating surface 16 of plate 18 varies as the spoon 14 is moved towards the lower spoon receiving position.

Figure 13:
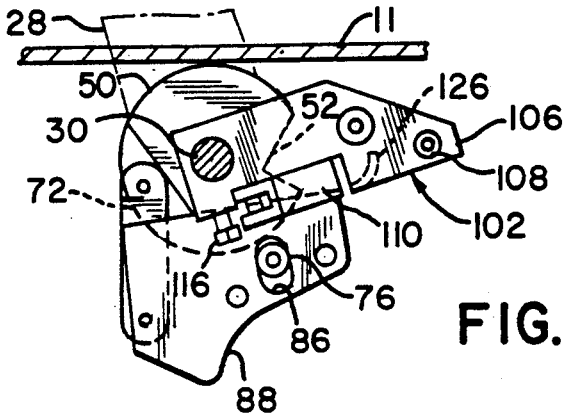
FIG. 13 is a partial cross-sectional view of the spoon-tilting mechanism of FIG. 9.
Figure 14:
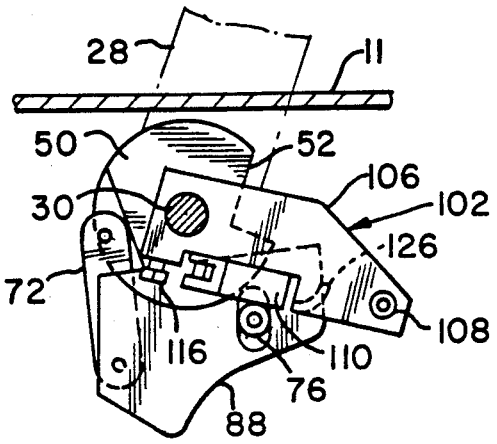
FIG. 14 is the view of the spoon-tilting mechanism of FIG. 13 engaged midway between the upper and lower positions.
Figure 15:
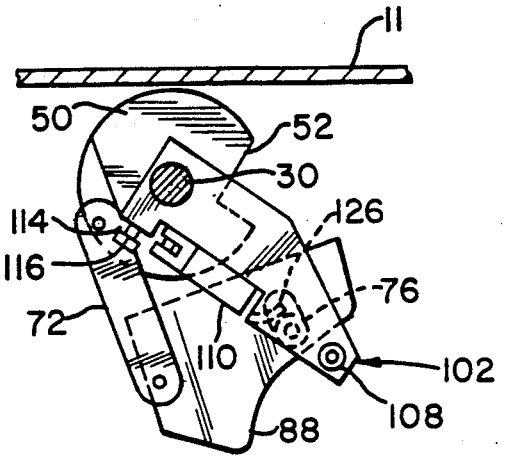
FIG. 15 is the view of the spoon-tilting mechanism of FIG. 14 engaged in a position closer to the lower food receiving position.

Referring now to FIG. 13, in the upper latched position the cam block 106 of the cam and guide block assembly 102 is oriented in the upper position. In this position the cam follower pin 108 is positioned to engage the housing 11 of the self-feeding device 10 if the arm 28 is moved too far past the upper eating position. As the spoon-lifting arm 28 is moved from the upper eating position to the lower food receiving position in response to rotation of the main shaft 30, the cam block 106 rotates with the main shaft 30 in the clockwise direction until the guide block 110 of the cam and guide block assembly engages the latch plate pin 76 as shown in FIG. 14.

Referring now to FIGS. 12, 14, 15 and 18, as the spoon-lifting arm 28 is moved further toward the lower eating position, engagement of the guide block 110 with the latch plate pin 76 causes the step gradation 78 of the latch plate 74 to move in a downwardly direction to cause the spoon-tilting mechanism 12 to enter into the unlatched position. As the spoon-lifting arm 28 is moved even further toward the lower eating position, the latch plate pin 76 rolls along the guide block 110 and a curved extension 126 of the cam block 106 to cause the latch plate pin 76 to engage and force the return cam 88 in the downwardly direction. This causes the link 72 to rotate the latch ring 50 and the main shaft pulley 46 in the counterclockwise direction, and causes the belt 42 to rotate the spoon shaft pulley 44 and the spoon shaft 32 in the counterclockwise direction. As a result, the spoon 14 swings down or rotates in the vertical direction in a generally arcuate path. Further movement of the spoon-lifting arm 28 to the lower position causes the spoon 14 to traverse the outer rim of the eating surface 16 of the plate 18. See FIG. 3.

Figure 16:
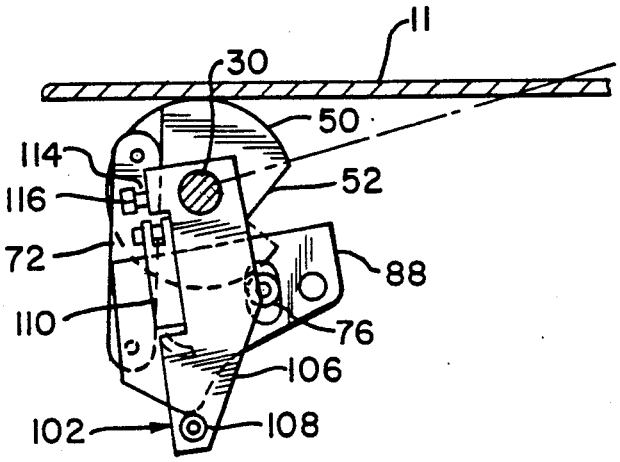
FIG. 16 is the view of the spoon-tilting mechanism of FIG. 15 engaged in the lower food receiving position.

After the spoon 14 traverses the outer rim of the eating surface 16 of the plate 18, the latch plate pin 76 rolls off of the curved extension 126 of the cam block 106 releasing the latch plate 74, the return cam 88 and the cam support 82. Action of the tension spring 36 and free rotation of the spoon shaft 32 and the spoon shaft pulley 44 now allow the spoon 14 to travel along the eating surface 16 of the plate 18 along a predetermined path to scoop food located along the path on to the spoon 14 as the spoon-lifting arm 28 is further moved into the lower food receiving. position Referring now to FIGS. 10, 11 and 16, after the latch plate pin 76 rolls off of the curved extension 126 of the cam block 106, the cam follower pin 108 is positioned under the return cam 88. As the spoon-lifting arm 28 is moved further towards the lower food receiving position, the cam follower pin 108 pushes the return cam 88 and the link 72 in an upwardly direction. This causes the latch ring 50 to rotate clockwise into the latched position with the latch plate 74. It should be realized by one of ordinary skill in the art that when the spoon 14 is traveling along the eating surface 16 of the plate 18, clockwise rotation of the spoon shaft 44 may cause the belt 42 to aid the clockwise rotation of the latch ring 50 into the latched position with latch plate 74.

After a sufficient amount of food is scooped on to the spoon 14, the spoon-tilting arm 28 is moved from the lower food receiving position to the upper eating position as shown in FIG. 2. During this motion, the spoon 14 travels at a nearly constant angle relative to the plate 18 to keep food from falling off of the spoon 14 and to maintain the spoon 14 at the proper orientation to allow the food to be easily ingested by an operator of the self-feeding device 10.

Figure 18:
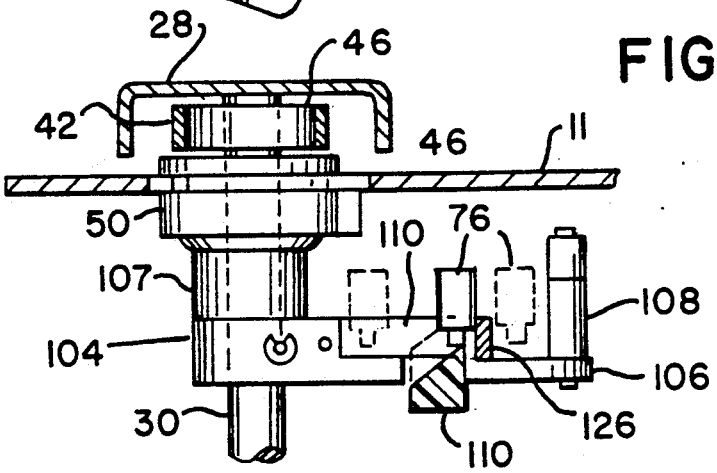
FIG. 18 is a partial cross-sectional view of the spoon-tilting mechanism of FIG. 17 taken along line 18—18 of FIG. 17.
Figure 17:
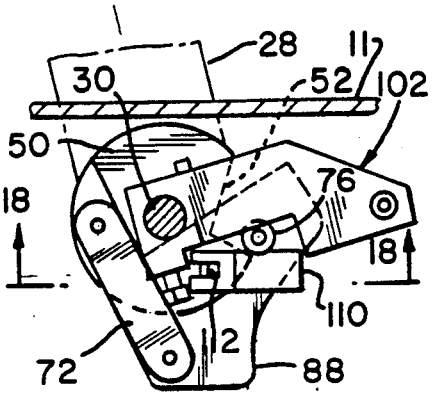
FIG. 17 is the view of the spoon-tilting mechanism of FIG. 16 engaged midway between the lower and upper positions.

Referring now to FIGS. 17 and 18, as the spoon-tilting arm 28 is moved from the lower food receiving position, the cam and guide block assembly 102 will rotate with the main shaft 30 in the counterclockwise direction until the guide block 110 of the cam and guide block assembly 102 comes into contact with the latch plate pin 76. Once contact is made, the guide block 110 will pivot on the guide block pin 112 outwards from the cam block 106 to allow the latch plate pin 76 to pass and the spoon-lifting arm 28 to continue on its upward motion to the upper eating position. After the latch plate pin 76 passes the guide block 110, the guide block will snap back into its normal position due to the biasing action of the spring 114.

The self-feeding apparatus of the present invention allows a handicapped person or operator to effectively load food on to the spoon. It is much more practical for an operator with poor head control to use, and is easier for an operator with good head control to use. The self-feeding apparatus includes both primary and secondary means of loading food on to the spoon. It is of simple and economical construction as well as being inexpensive to manufacture and use.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A self-feeding device for lifting food off of an eating surface of a plate to an eating position located above said device, said device comprising:

means for supporting a plate having a generally planar eating surface;

a spoon having a longitudinal axis; and spoon support means for moving said spoon from an upper eating position to a lower food receiving position and for causing said spoon to travel along a predetermined path on said eating surface of said plate to load food located along said path onto said spoon as said spoon moves from said upper eating position to said lower food receiving position; said predetermined path extending from a first position located near an edge of said plate to a second position located nearer the center of said plate, said spoon support means including spoon-tilting mechanism which causes an angle between said longitudinal axis of said spoon and said eating surface to vary in a controlled manner as said spoon moves from said upper eating position into said lower food receiving position and which causes said longitudinal axis of said spoon to be substantially horizontal during most of its travel from said lower food receiving position into said upper eating position.

2. The self-feeding device as claimed in claim 1, further comprising human actuable control means operable in a first mode wherein said control means causes said spoon support means to move said spoon from said upper eating position to said lower food receiving position.

3. The self-feeding device as claimed in claim 2, wherein said control means is also operable in a second mode wherein said control means causes said spoon support means to move said spoon from said lower food receiving position to said upper eating position after said food has been loaded on to said spoon.

4. The self-feeding device as claimed in claim 1, further comprising means to maintain said spoon at a nearly constant angle relative to said plate when said spoon is moved from said lower food receiving position to said upper eating position.

5. The self-feeding device as claimed in claim 1, wherein said spoon-tilting mechanism includes a spoon-lifting arm rotatable about a first predetermined axis and means for rotatably coupling said spoon to said arm about a second predetermined axis.

6. The self-feeding device as claimed in claim 5, wherein said means for rotatably coupling said spoon includes means for rotating said spoon about said second axis.

7. The self-feeding device as claimed in claim 6, wherein said means for rotatably coupling said spoon includes means for rotating said spoon about said second axis when said arm rotates about said first axis.

8. The self-feeding device as claimed in claim 5, wherein said first axis is parallel to and spaced from said second axis.

9. The self-feeding device as claimed in claim 5, wherein said spoon is resiliently coupled to said spoon-lifting arm.

10. The self-feeding device as claimed in claim 5, wherein said spoon rotates about said second axis from said upper eating position to said lower food receiving position along a generally arcuate path so that said tip of said spoon traverses said eating surface of said plate as it moves into said lower food receiving position.

11. The self-feeding device as claimed in claim 6, wherein said spoon rotates about said second axis when moved between said upper and lower food positions.

12. The self-feeding device as claimed in claim 6, wherein said means for rotating said spoon includes a latch ring rotatable about said first axis, said latch ring having a notch formed therein.

13. The self-feeding device as claimed in claim 12, wherein said means to rotate said spoon further includes a latch and return cam assembly pivotable about a third predetermined axis.

14. The self-feeding device as claimed in claim 13, wherein said latch and return cam assembly is coupled to said latch ring to regulate rotation of said latch ring.

15. The self-feeding device as claimed in claim 14, wherein said latch and return cam assembly includes a latch plate assembly having a latch plate pivotable about said third axis and, a latch plate pin projecting from said latch plate.

16. The self-feeding device as claimed in claim 13, wherein said third axis is parallel to and spaced from said first axis.

17. The self-feeding device as claimed in claim 15, wherein said latch plate blocks rotation of said latch ring in a latched position by abutting said notch when said arm is moved from said lower food receiving position to said upper eating position to maintain said spoon at a nearly constant angle relative to said eating surface of said plate.

18. The self-feeding device as claimed in claim 15, wherein said latch plate permits rotation of said latch ring in an unlatched position by disengaging said latch ring when said arm is moved from said upper eating position to said lower food receiving position.

19. The self-feeding device as claimed in claim 18, wherein said latch and return cam assembly further includes a return cam having means to engage said latch plate pin, a link to couple said return cam to said latch ring, a cam support pivotable about said third axis fixed to said return cam and positioned between said latch plate and said return cam, said cam support having means to allow said latch plate pin to pass therethrough.

20. The self-feeding device as claimed in claim 19, wherein said return cam causes said latch ring to rotate when said latch plate is in said unlatched position 21. The self-feeding device as claimed in claim 20, wherein said means to rotate said spoon further includes a cam and guide block assembly rotatable about said first axis to unlatch said latch ring.

22. The self-feeding device as claimed in claim 21, wherein said cam and guide block assembly includes a cam block and a cam follower pin projecting from said cam block towards said return cam, said cam block engaging said latch plate pin when said arm is moved from said upper eating position to unlatch said latch ring to engage said return cam and rotate said latch ring.

23. The self-feeding device as claimed in claim 22, wherein said latch plate pin becomes disengaged with said cam block releasing said latch plate and causing said cam follower pin to push said return cam to rotate said latch ring into said latched position when said arm is moved from said upper eating position.

24. The self-feeding device as claimed in claim 22, wherein said latch ring is rotated counterclockwise to cause said spoon to tilt in said downwardly direction.

25. The self-feeding device as claimed in claim 23, wherein said latch ring is rotated clockwise to cause said latch ring to rotate into said latched position.

26. The self-feeding device as claimed in claim 5, further comprising means to prevent said arm from moving beyond said upper eating position.

27. The self-feeding device as claimed in claim 26, wherein said means to prevent includes said cam follower pin blocking rotation of said arm past a predetermined point.

28. The self-feeding device as claimed in claim 23, wherein said cam and guide block assembly further includes a guide block pivotable about said cam block, said latch plate pin passing through said guide block when said guide block pivots about said cam block to allow said arm to move to said upper eating position.

29. A self-feeding device for lifting food off of an eating surface of a plate to an eating position located above said device, said device comprising:

means for supporting a plate having a generally planar eating surface;

a spoon having a longitudinally axis; and spoon support means for moving said spoon from an upper eating position to a lower food receiving position and for causing said spoon to travel along a first predetermined path on said eating surface of said plate to load a first amount of food located along said path onto said spoon as said spoon moves from said upper eating position to said lower food receiving position, said predetermined path extending from a first position located near and edge of said plate to a second position located nearer the center of said plate, said spoon support means including spoon-tilting mechanism which causes an angle between said longitudinal axis of said spoon and said eating surface to vary in a controlled manner as said spoon moves from said upper eating position into said lower food receiving position and which causes said longitudinal axis of said spoon to be substantially horizontal during most of its travel from said lower food receiving position into said upper eating position;

pusher means including a food pushing surface, said pusher means being capable of moving said food pushing surface along a second predetermined path which traverses a portion of said eating surface of said plate in such a manner that a second amount of food located on said eating surface of said plate along said second predetermined path is moved by said pushing surface onto said spoon after said spoon loads said first amount of food onto said spoon at said lower food receiving position, said path being generally arcuate as viewed in a first plane parallel to said eating surface and generally polygonal as viewed in a second plate orthogonal to said first plane; and human actuable control means operable in a first mode wherein said control means causes said spoon support means to move said spoon from said upper eating position to said lower food receiving position to load said first amount of food onto said spoon and a second mode wherein said control means causes said spoon support means to move said spoon from said lower food receiving position to said upper eating position after said food is loaded onto said spoon.

30. The self-feeding device as claimed in claim 29, wherein said spoon support means includes a spoon-lifting arm rotatable about a predetermined axis and wherein said spoon is resiliently coupled to said spoon-lifting arm.

31. The self-feeding device as claimed in claim 29, wherein said plate support means is capable of rotating said plate about a predetermined axis.

32. The self-feeding device as claimed in claim 31, wherein said control means is also operable in a third mode wherein said control means causes said plate support means to rotate said plate about said axis by an angle determined by said operator of said self-feeding device whereby said operator may determine which position of said plate is traversed by said spoon and said pushing surface.

33. The self-feeding device as claimed in claim 32, wherein said support means comprises a plurality of vertical shaft rollers.

34. The self-feeding device as claimed in claim 32, wherein said control means is also operable in a fourth mode wherein when said spoon is in said lower food receiving position said control means causes said pusher means to move said pusher surface along said second predetermined path such that said second amount of food located on said eating surface is loaded onto said spoon responsive to said selective actuation of said control means by said operator.

35. The self-feeding device as claimed in claim 33, wherein said plate contacts only said rollers.

36. A spoon-tilting-mechanism in a self-feeding device for lifting food off said eating surface of a plate to an eating position located above said plate said spoon-tilting mechanism comprising:

a spoon-lifting arm rotatable about a first predetermined axis including means to rotatably couple a spoon to said arm about a second predetermined axis, said arm being capable of moving said spoon between a lower food receiving position in which food is loaded on to said spoon by said spoon and an upper eating position in which said food loaded on to said spoon is located at said upper eating position, and means to rotate said spoon about said second axis when said arm rotates about said first axis to cause said spoon to traverse and travel along a predetermined path on said eating surface of said plate to load food located on said predetermined path on to said spoon at said lower food receiving position;

a latch ring rotatable about said first axis to tilt said spoon from said upper eating position, said latch ring including a notch formed therein;

a latch and return cam assembly pivotable about a third predetermined axis and coupled to said latch ring to regulate said rotation of said latch ring, said latch and return cam assembly including a latch plate assembly having a latch plate pivotable about said third axis and a latch plate pin projecting therefrom, said latch plate to block rotation of said latch ring in a latched position by abutting said notch when said arm is moved from said lower food receiving position and to permit rotation of said latch ring in an unlatched position by disengaging said latch ring when said arm is moved between said upper and lower positions, a return cam having means to engage said latch plate pin, a link to couple said return cam to said latch ring, a cam support pivotable about said third axis fixed to said return cam and positioned between said latch plate and said return cam and fixed to said return cam, said cam support having means to allow said latch plate pin to pass therethrough, said return cam causing said latch ring to rotate when said latch plate is in said unlatched position; and a cam and guide block assembly rotatable about said first axis to unlatch said latch ring, said assembly including a cam block and a cam follower pin projecting from said cam block towards said return cam, said cam block engaging said latch plate pin when said arm is moved from said upper eating position to unlatch said latch ring and engage said return cam in a downwardly direction to rotate said latch ring.

37. A self-feeding device as claimed in claim 36, wherein said latch plate becomes disengaged with said cam block releasing said latch plate and causing said cam follower pin to push said return cam to rotate said latch ring into said latched position when said arm is moved from said lower food receiving position.

38. A self-feeding device as claimed in claim 37, wherein said cam and guide block assembly further includes a guide block pivotable about said cam block, said latch plate pin passing through said guide block when said guide block pivots about said cam block to allow said arm to move to said upper eating position.

39. The self-feeding device of claim 1, wherein said plate is generally circular in shape and said predetermined path is generally along a radius of said plate.

40. The self-feeding device of claim 29, wherein said spoon support means causes the angle between said longitudinal axis and said eating surface to remain substantially constant said spoon is moved from said lower food receiving position to said upper eating position.

41. A self-feeding device for lifting food off an eating surface of a plate to an eating position located above said device, said device comprising:

means for supporting the plate having an eating surface;

a spoon;

spoon support means for moving said spoon from an upper eating position to a lower food receiving position and for causing said spoon to travel along a predetermined path on said eating surface of said plate to load food located along said path onto said spoon as said spoon moves from said upper eating position to said lower food receiving position;

said spoon support means including a spoon-tilting mechanism which causes said tip of said spoon to move along an arcuate path as it moves into said lower food receiving position;

said spoon-tilting mechanism including a spoon lifting arm rotatable about a first predetermined axis and means for rotatably coupling said spoon to said arm for rotation about a second predetermined axis;

said means for rotatably coupled to said spoon including means for rotating said spoon about said second axis; and said means for rotating said spoon including a latch ring rotatable about said first axis, said latch ring having a first notch formed therein.

42. The self-feeding device as claimed in claim 41, wherein said means to rotate said spoon further includes a latch and return cam assembly pivotable about a third predetermined axis.

43. The self-feeding device as claimed in claim 42, wherein said latch and return cam assembly is coupled to said latch ring to regulate rotation of said latch ring.

44. The self-feeding device as claimed in claim 43, wherein said latch and return cam assembly includes a latch plate assembly having a latch plate pivotable about said third axis and, a latch plate pin projecting from said latch plate.

45. The self-feeding device as claimed in claim 42, wherein said third axis is parallel to and spaced from said first axis.

46. The self-feeding device as claimed in claim 44, wherein said latch plate blocks rotation of said latch ring in a latched position by abutting said notice when said arm is moved from said lower food receiving position to said upper eating position to maintain said spoon at a nearly constant angle relative to said eating surface of said plate.

47. The self-feeding device as claimed in claim 44, wherein said latch plate permits rotation of said latch ring in an unlatched position by disengaging said latch ring when said arm is moved from said upper eating position to said lower food receiving position.

48. The self-feeding device as claimed in claim 47, wherein said latch and return cam assembly further includes a return cam having means to engage said latch plate pin, a link to couple said return cam to said latch ring, a cam support pivotable about said third axis fixed to said return cam and positioned between said latch plate and said return cam, said cam support having means to allow said latch plate pin and pass therethrough.

49. The self-feeding device as claimed in claim 48, wherein said return cam causes said latch ring to rotate when said latch plate is in said unlatched position.

50. The self-feeding device as claimed in claim 49, wherein said means to rotate said spoon further includes a cam and guide block assembly rotatable about said first axis to unlatch said latch ring.

51. The self-feeding device as claimed in claim 50, wherein said cam and guide block assembly includes a cam block and a cam follower pin projecting from said cam block towards said return cam, said cam block engaging said latch plate pin when said arm is moved from said upper eating position to unlatch said latch ring to engage said return cam and rotate said latch ring.

52. The self-feeding device as claimed in claim 51, wherein said latch plate pin becomes disengaged with said cam block releasing said latch plate and causing said cam follower pin to push said return cam to rotate said latch ring into said latched position when said arm is moved from said upper eating position.

53. The self-feeding device as claimed in claim 51, wherein said latch ring is rotated counterclockwise to cause said spoon to tilt in said downwardly direction.

54. The self-feeding device as claimed in claim 52, wherein said latch ring is rotated clockwise to cause said latch ring to rotate into said latched position.

55. The self-feeding device as claimed in claim 52, wherein said cam and guide block assembly further includes a guide block pivotable about said cam block, said latch plate pin passing through said guide block when said guide block pivots about said cam block to allow said arm to move to said upper eating position.

* * * * *